US009686602B2

(12) United States Patent
Hou et al.

(10) Patent No.: US 9,686,602 B2
(45) Date of Patent: Jun. 20, 2017

(54) GREEN HEADPHONE

(71) Applicant: UNEO Inc., Taipei (TW)

(72) Inventors: Chih-Sheng Hou, Taipei (TW); Cheng-Tsung Chen, Taipei (TW); Chia-Hung Chou, Taipei (TW)

(73) Assignee: Uneo Inc., Taipei (TW)

( * ) Notice: Subject to any disclaimer, the term of this patent is extended or adjusted under 35 U.S.C. 154(b) by 30 days.

(21) Appl. No.: 14/739,636

(22) Filed: Jun. 15, 2015

(65) Prior Publication Data

US 2016/0366507 A1 Dec. 15, 2016

(51) Int. Cl.
*H04R 1/10* (2006.01)

(52) U.S. Cl.
CPC ..... *H04R 1/1041* (2013.01)

(58) Field of Classification Search
CPC .... H04R 1/1041; H04R 2420/07; H04R 5/04; H04R 1/1016; H04R 3/00; H04R 5/033; H04R 1/1025; H04R 2201/107; H04R 2205/022; H04R 2225/61; H04R 2420/03; H04R 2430/01; H04R 2460/01; H04R 2460/03; H04R 2499/11; H04R 1/028; H04R 1/105; H04R 1/1008; H04R 1/1066
USPC ..... 381/74, 58, 73.1, 120, 311, 322, 328, 381/333, 380, 72, 77, 56, 71.6, 381, 394, 381/71.1, 71.11
See application file for complete search history.

(56) References Cited

U.S. PATENT DOCUMENTS

2014/0016803 A1* 1/2014 Puskarich ..... H04R 1/1041 381/309
2014/0064500 A1* 3/2014 Lee ..... H04R 1/1041 381/58
2014/0161412 A1* 6/2014 Chase ..... H04N 21/2743 386/224
2014/0242964 A1* 8/2014 Seo ..... H04M 1/6058 455/418
2014/0254818 A1* 9/2014 Tse ..... H04R 1/1041 381/74
2015/0358716 A1* 12/2015 Zhu ..... H04R 1/1041 381/74
2016/0353194 A1* 12/2016 Stevens ..... H04R 1/1041

* cited by examiner

*Primary Examiner* — Akelaw Teshale
(74) *Attorney, Agent, or Firm* — Hauptman Ham, LLP

(57) ABSTRACT

A green headphone is disclosed. A force sensor is configured between a speaker cover and a cushion of the headphone. The headphone switches on automatically to play audio when a user puts the headphone on his head. The headphone switches off automatically to stop playing audio when a user puts the headphone off his head, the power consumption is saved.

9 Claims, 15 Drawing Sheets

GREEN HEADPHONE

BACKGROUND

Technical Field

The present invention relates to a head phone, especially relates to a Green Headphone, the green headphone switches on automatically to start audio transmission when a user put the headphone on his head, and the green headphone switches off automatically to stop audio transmission when a user put the headphone off his head.

Description of Related Art

FIGS. 1A~1B show a prior art.

FIG. 1A shows an exploded three-dimensional view of a prior art headphone. The traditional headphone has a left speaker set LS and a right speaker set RS bridged by a spring head band 13. The left speaker set LS has a speaker (not shown) for playing audio and a speaker cover 11 configured outside for protecting the speaker inside. A cushion 15 is configured on the speaker cover 11. The right speaker RS has similar structure and is omitted herein for simplification.

FIG. 1B shows a side view of FIG. 1A.

FIG. 1B shows the speaker cover 11 and the cushion 13. The cushion 13 is mounted onto the speaker cover 11 for a finished headphone. The traditional headphone plays audio coming from an audio source such as a computer, radio, TV . . . etc., a switch to turn on/off or to play/pause the audio signal is configured on the main body of the computer, radio or TV respectively.

Power energy is wasted for the traditional headphone when a user puts off the headphone and goes to pick a phone call, as an example, the audio signal continues broadcasting, which consumes the power energy while the user is not listening on. Green products are pursued nowadays for all electronic devices because energy crisis has become a critical issue due to a large amount power consumed electronic devices have been used by the people in the world.

DETAILED DESCRIPTION OF THE INVENTION

An energy saving headphone is disclosed. The headphone automatically turns on when a user puts on the headphone, and the headphone automatically turns off to save energy when a user puts off the headphone.

Figure 1B:
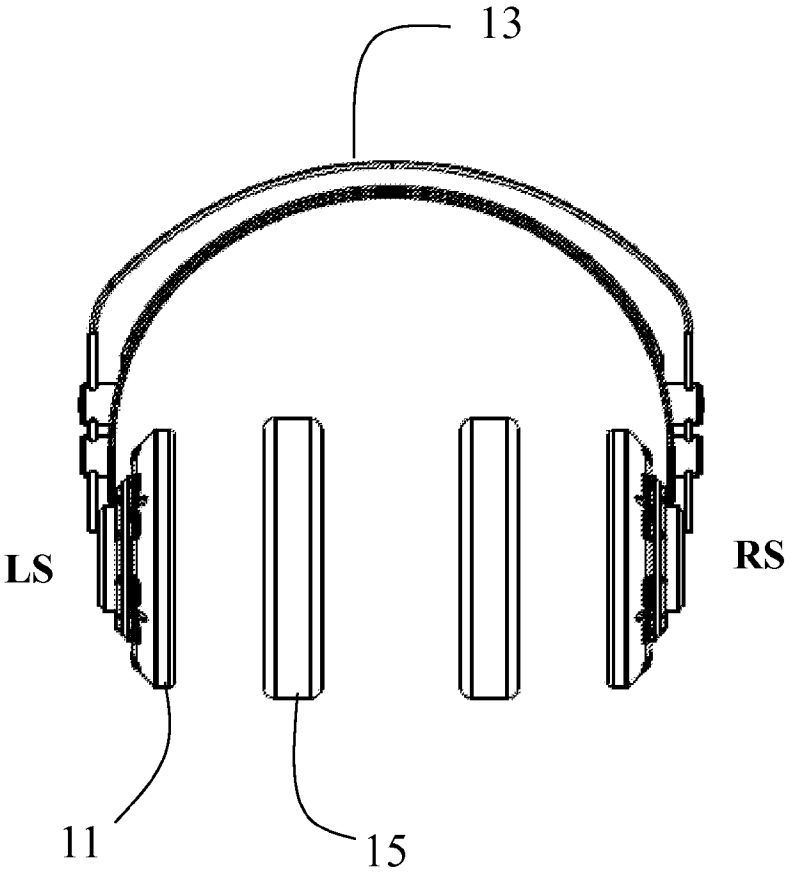
Fig.1B Prior Art
FIGS. 1A~1B show a prior art.
Figure 1A:
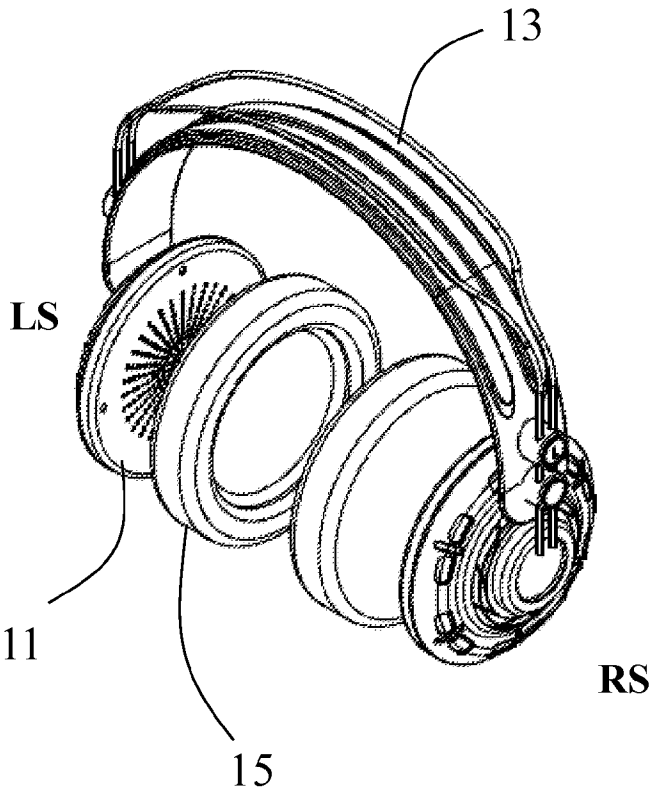
Fig.1A Prior Art
Figure 2B:
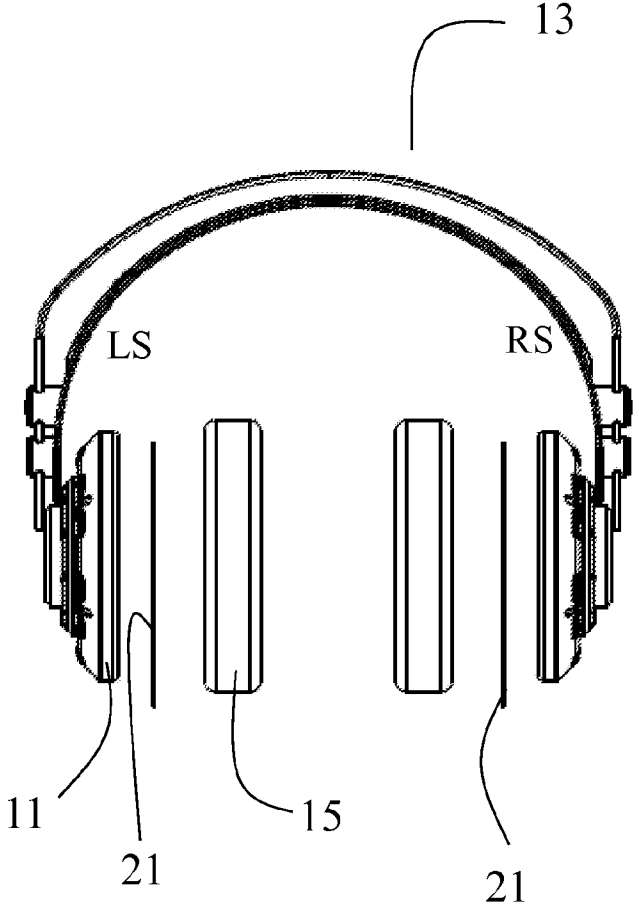
FIGS. 2A~2B show an embodiment of a green headphone according to the present invention.
Figure 2A:
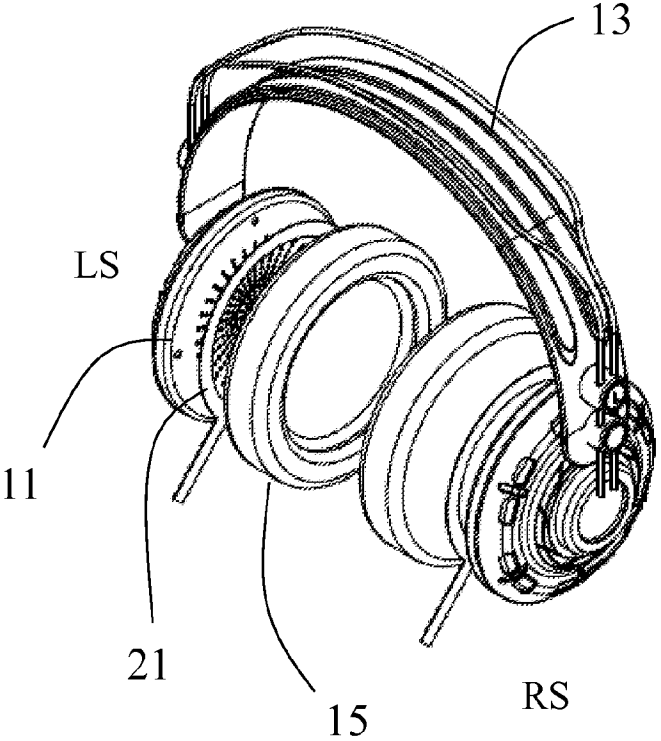

FIGS. 2A~2B show an embodiment of a green headphone according to the present invention.

FIG. 2A shows an exploded three-dimensional view of the embodiment. A green headphone has a left speaker set LS and a right speaker set RS bridged with a spring head band 13. The left speaker set LS has a speaker inside, and a speaker cover 11 is configured outside the speaker for protecting the speaker. A cushion 15 is configured on the speaker cover 11. The right speaker set RS has similar structure and is omitted herein for simplification.

A force sensor 21 is configured on an outer surface of the speaker cover 11. In other words, the force sensor 21 is sandwiched in between the cushion 15 and the speaker cover 11. An automatic "power on" or "audio play" signal is generated when the cushion 15 presses against the force sensor 21 at a time when a user puts on the headphone. Similarly an automatic "power off" or "audio pause" signal is generated when the cushion 15 releases the pressure from the force sensor 21 at a time when the user puts off the headphone.

FIG. 2B shows a side view of FIG. 2A.

FIG. 2B shows a force sensor 21 configured between the speaker cover 11 and the cushion 13. The cushion 13 is mounted onto the speaker cover 11 for a finished headphone.

Figure 3B:
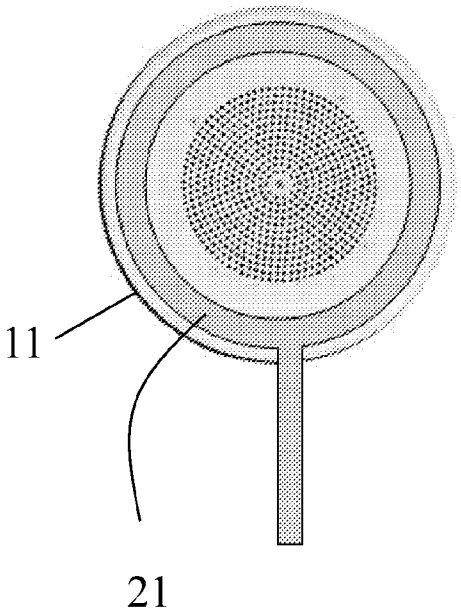
FIGS. 3A~3B show a front view of the embodiment according to the present invention.
Figure 3A:
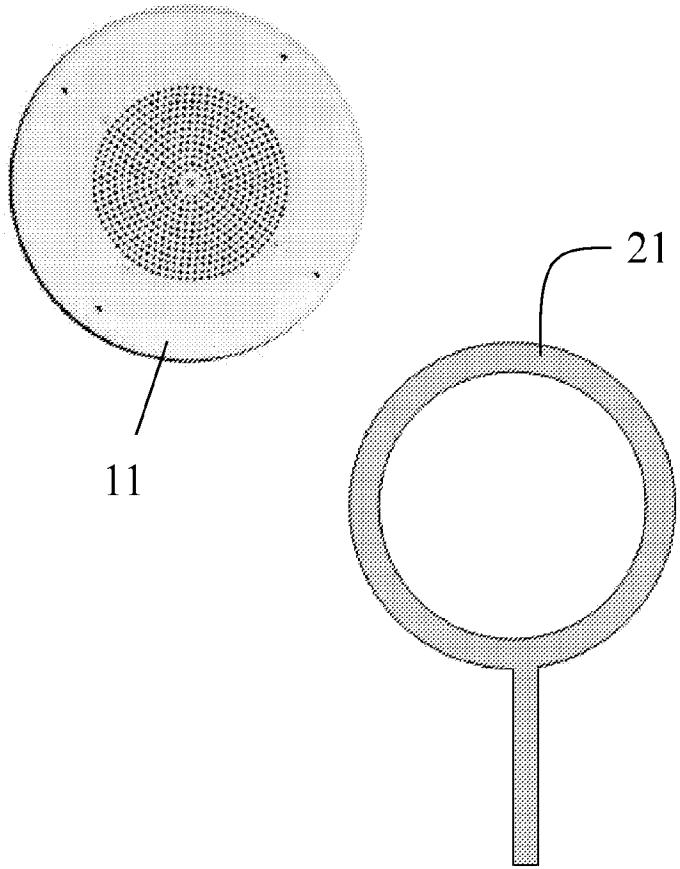

FIGS. 3A~3B show a front view of the embodiment according to the present invention.

FIG. 3A shows that a speaker cover plate 11 and a force sensor 21 are prepared.

FIG. 3B shows the force sensor 21 is configured on a top surface of the speaker cover plate 11. Next, a cushion 15 (not shown) is then configured on a top surface of the speaker cover plate 11 and sandwiched the force sensor 21 in between.

Figure 4B:
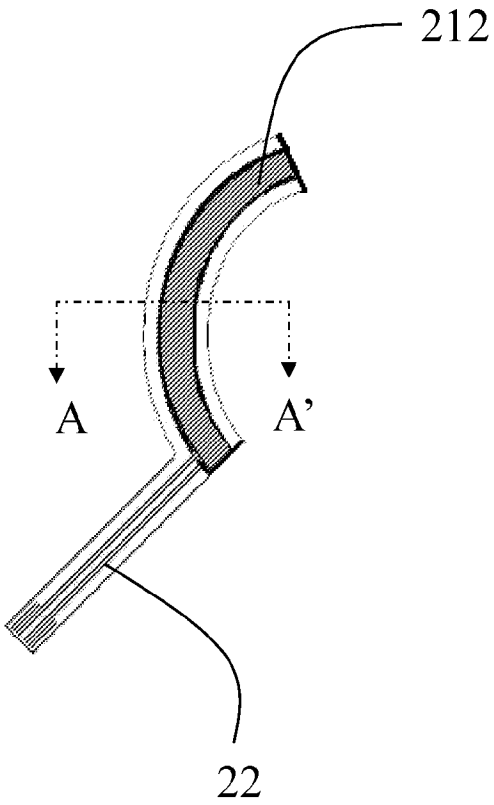
FIG. 4B shows a second profile of the force sensor according to the present invention.
Figure 4A:
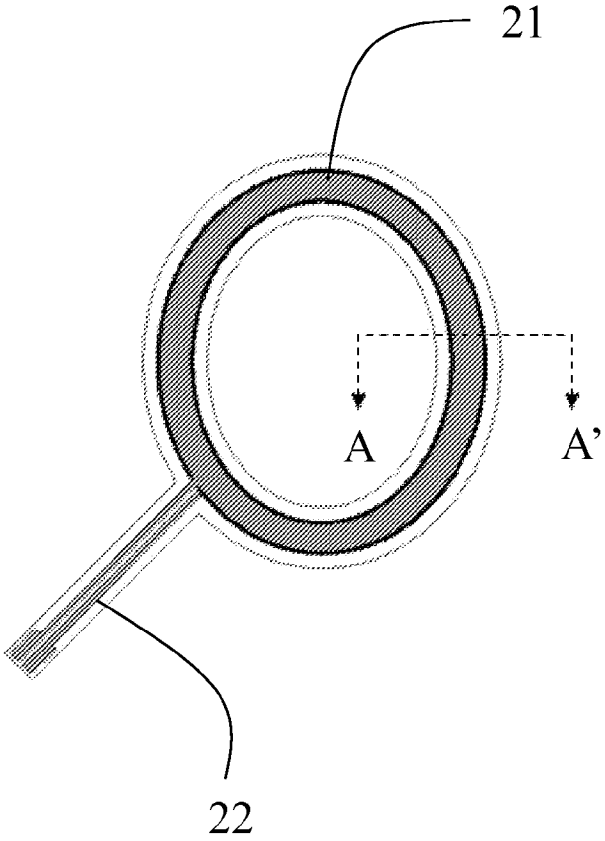
FIG. 4A shows a first profile of the force sensor according to the present invention.

FIG. 4A shows a first profile of the force sensor according to the present invention.

FIG. 4A shows the force sensor 21 has a profile of a ring. Signal wires 22 are extended from the force sensor 21 to electrically couple to a control system (not shown). The ring shaped force sensor 21 is configured on a top surface of the speaker cover 11. The force sensor 21 triggers a "turn on" or "audio play" signal when the cushion 13 presses against the force sensor 21 at a time when the headphone is put on a user's head. The force sensor 21 triggers a "turn off" or "audio pause' signal when the cushion 13 is released from the force sensor 21 at a time when the headphone is put off a user's head.

FIG. 4B shows a second profile of the force sensor according to the present invention.

FIG. 4B shows the force sensor 212 has a profile of a partial ring which is near to or larger than one-third of a ring. Signal wires 22 are extended from the force sensor 212 to electrically couple to a control system (not shown).

Figure 5:
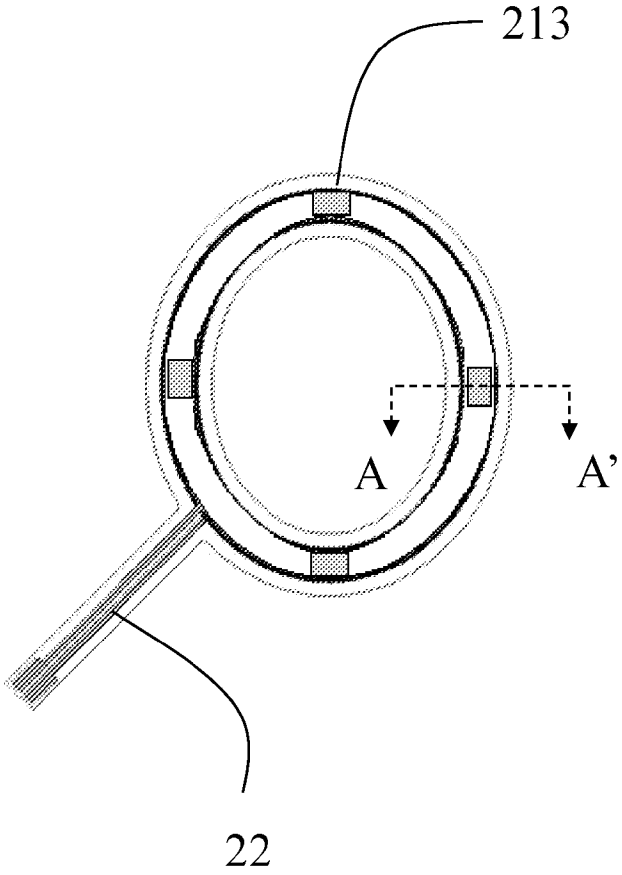
FIG. 5 shows a third profile of the force sensor according to the present invention.

FIG. 5 shows a third profile of the force sensor according to the present invention.

FIG. 5 shows the force sensor 213 has a profile of a pad. A plurality of force sensor pads 213 are parallel connected and mounted on a top surface of the speaker cover 11. Signal wires 22 are extended from the force sensor pads 213 to electrically couple to a control system (not shown).

Figure 6A:
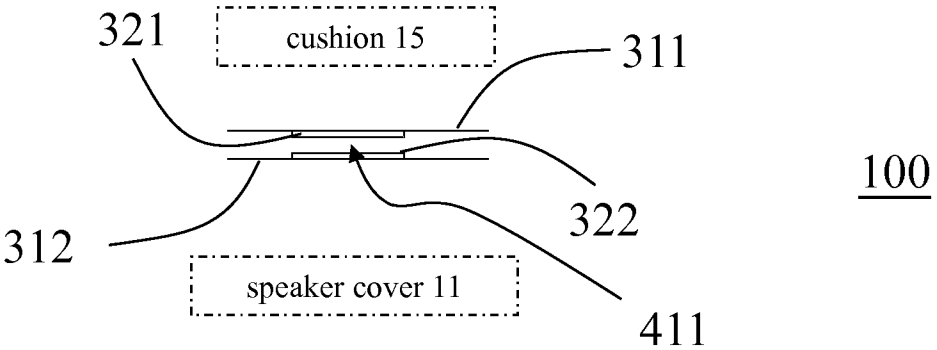
FIGS. 6A~6B show a first example for AA' section view of the force sensor according to the present invention.
Figure 6B:
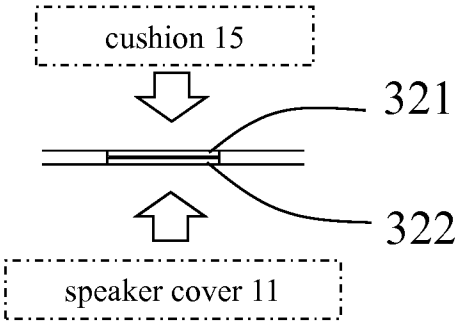

FIGS. 6A~6B show a first example for AA' section view of the force sensor according to the present invention.

FIG. 6A shows a membrane switch can be used as one of the first sensors which can be used according to the present invention. FIG. 6A shows a first force sensor 100 which has a top substrate 311 and a bottom substrate 312. A top electrode 321 is configured on a bottom surface of the top substrate 311 and a bottom electrode 322 is configured on a top surface of the bottom substrate 312. A gap 411 is reserved between the top electrode 321 and the bottom electrode 322.

FIG. 6B shows when the headphone is put on a user' head, the cushion 15 is pushed against the force sensor 21, 212, 213, which causes the top electrode 321 of the force sensor touching the bottom electrode 322 of the force sensor. An electrical path is established between the two electrodes and a corresponding electrical signal is generated to trigger a "power on" or "audio play" signal, the audio transmission starts to transmit to the headphone speakers. And when the headphone is put off a user' head, the cushion 13 is released from the force sensor, which causes the top electrode 321 leaving the bottom electrode 322, The electrical path between the two electrodes interrupts and a corresponding electrical signal is generated to trigger a "power off" or "audio pause" signal, the audio transmission stops so as to save power energy.

Figure 7A:
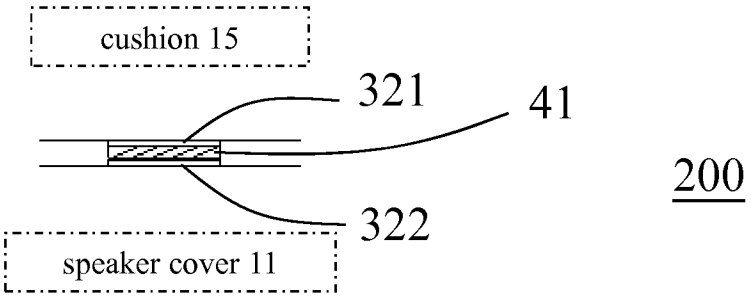
FIGS. 7A~7B show a second example for AA' section view of the force sensor according to the present invention.
Figure 7B:
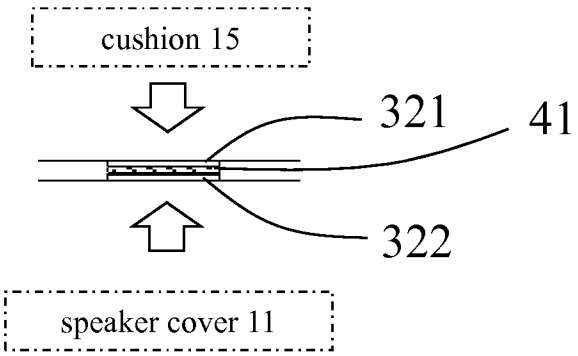

FIGS. 7A~7B show a second example for AA' section view of the force sensor according to the present invention.

FIG. 7A shows a second force sensor 200. The second force sensor has a piece of piezo sheet 41 configured on a bottom surface of the top electrode 321. The piezo sheet 41 has a bottom surface touching, but not giving a force to, a top surface of the bottom electrode 322.

FIG. 7B shows when the headphone is put on a user' head, the cushion 15 is pushed against the force sensor 21, 212, 213, which causes the piezo sheet 41 of the force sensor squeezed. An electrical path is established between the two electrodes and a corresponding electrical signal is generated to trigger a "power on" or "audio play" signal, the audio transmission starts to transmit to the headphone speakers. And when the headphone is put off a user' head, the cushion 13 is released from the force sensor, which causes the squeezed piezo sheet released, The electrical path between the two electrodes interrupts and a corresponding electrical signal is generated to trigger a "power off" signal, the audio transmission stops so as to save power energy.

Figure 8A:
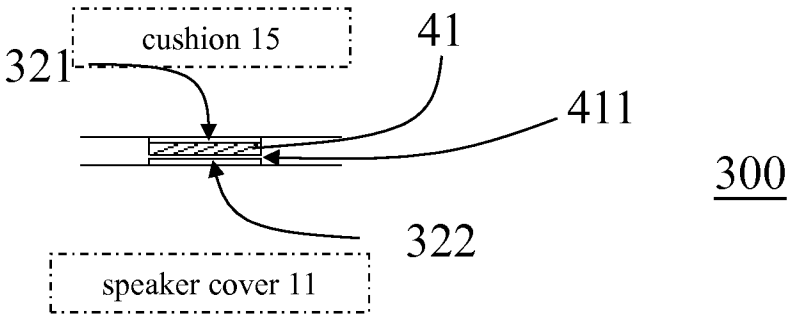
FIGS. 8A~8B show a third example for AA' section view of the force sensor according to the present invention.
Figure 8B:
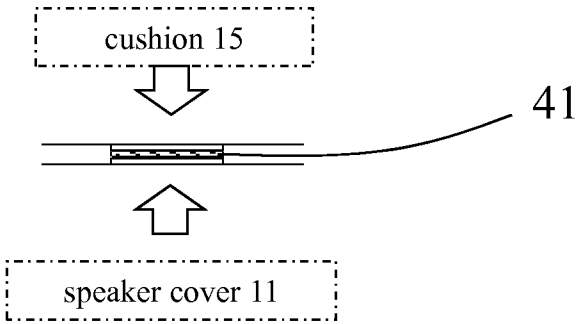

FIGS. 8A~8B show a third example for AA' section view of the force sensor according to the present invention.

FIG. 8A shows a third force sensor 300. The third force sensor 300 is similar to FIG. 7A but a space 411 is reserved between the piezo sheet 41 and the bottom electrode 322.

FIG. 8B is similar to that of FIG. 7B to show that when the headphone is put on a user' head, the cushion 15 is pushed against the force sensor 21, 212, 213, which causes the piezo sheet 41 of the force sensor squeezed. An electrical path is established between the two electrodes and a corresponding electrical signal is generated to trigger a "power on" or "audio play" signal, the audio transmission starts to transmit to the headphone speakers. And when the headphone is put off a user' head, the cushion 13 is released from the force sensor, which causes the squeezed piezo sheet released, The electrical path between the two electrodes interrupts and a corresponding electrical signal is generated to trigger a "power off" or "audio pause" signal, the audio transmission stops so as to save power energy.

Figure 9A:
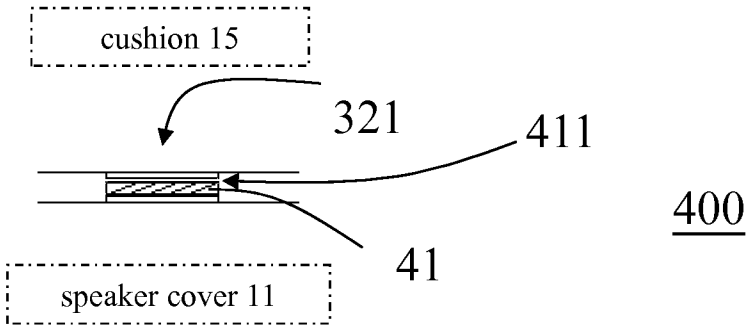
FIGS. 9A~9B show a fourth example for AA' section view of the force sensor according to the present invention.
Figure 9B:
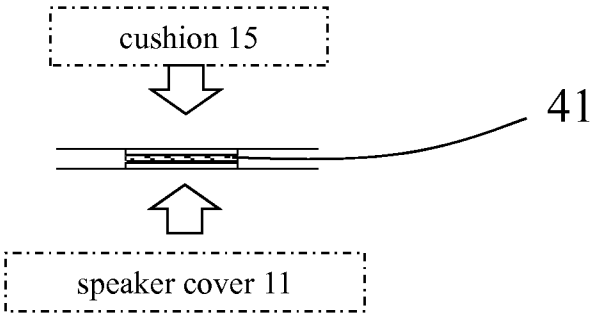

FIGS. 9A~9B show a fourth example for AA' section view of the force sensor according to the present invention.

FIG. 9A shows a fourth force sensor 400. The fourth force sensor is similar to FIG. 8A but a space 411 is reserved between the piezo sheet 41 and the top electrode 321.

FIG. 9B is similar to that of FIG. 8B to show that when the headphone is put on a user' head, the cushion 15 is pushed against the force sensor 21, 212, 213, which causes the piezo sheet 41 of the force sensor squeezed. An electrical path is established between the two electrodes and a corresponding electrical signal is generated to trigger a "power on" or "audio play" signal, the audio transmission starts to transmit to the headphone speakers. And when the headphone is put off a user' head, the cushion 13 is released from the force sensor, which causes the squeezed piezo sheet released, The electrical path between the two electrodes interrupts and a corresponding electrical signal is generated to trigger a "power off" or "audio pause" signal, the audio transmission stops so as to save power energy.

Figure 10A:
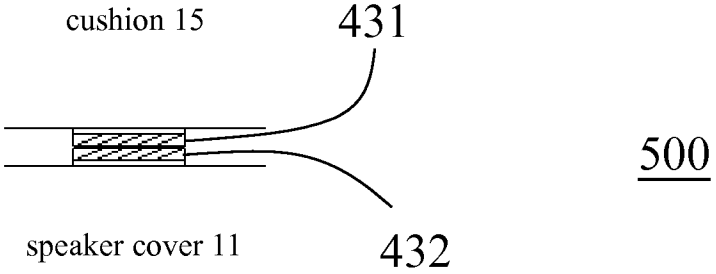
FIGS. 10A~10B show a fifth example for AA' section view of the force sensor according to the present invention.
Figure 10B:
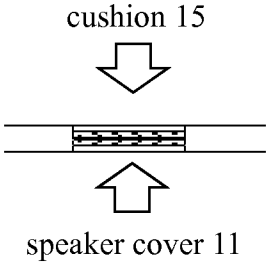

FIGS. 10A~10B show a fifth example for AA' section view of the force sensor according to the present invention.

FIG. 10A shows a fifth force sensor 500. The fifth force sensor shows that a top piezo sheet 431 is configured on a bottom surface of the top electrode 321. A bottom piezo sheet 432 is configured on a top surface of the bottom electrode 322. The top piezo sheet 431 has a bottom surface touching, but not giving a force to, a top surface of the bottom piezo sheet 432.

FIG. 10B shows that when the headphone is put on a user' head, the cushion 15 is pushed against the force sensor 21, 212, 213, which causes the piezo sheet 431, 432 of the force sensor squeezed. An electrical path is established between the two electrodes and a corresponding electrical signal is generated to trigger a "power on" or "audio play" signal, the audio transmission starts to transmit to the headphone speakers. And when the headphone is put off a user' head, the cushion 13 is released from the force sensor, which causes the squeezed piezo sheet 431,432 released, The electrical path between the two electrodes interrupts and a corresponding electrical signal is generated to trigger a "power off" or "audio pause" signal, the audio transmission stops so as to save power energy.

Figure 11A:
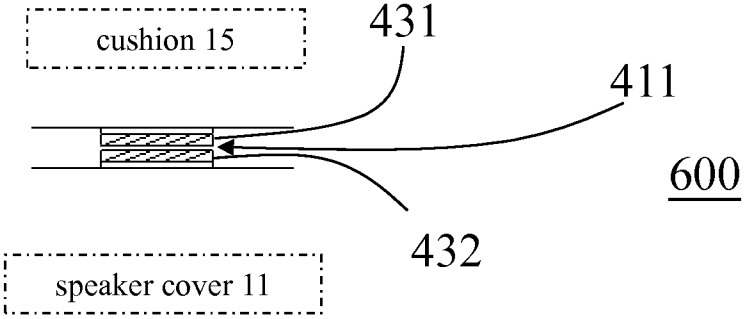
FIGS. 11A~11B show a sixth example for AA' section view of the force sensor according to the present invention.
Figure 11B:
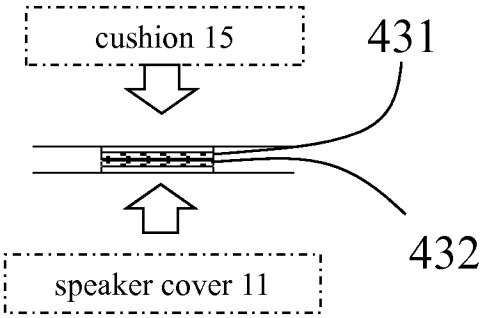

FIGS. 11A~11B show a sixth example for AA' section view of the force sensor according to the present invention.

FIG. 11A shows a sixth force sensor 600. The sixth force sensor is similar to FIG. 10A but a space 411 is inserted in between the top piezo sheet 431 and the bottom piezo sheet 432. The rest structure is the same as that of FIG. 10A and omitted herein.

FIG. 11B is similar to that of FIG. 10B to show that when the headphone is put on a user' head, the cushion 15 is pushed against the force sensor 21, 212, 213, which causes the piezo sheet 431, 432 of the force sensor squeezed. An electrical path is established between the two electrodes and a corresponding electrical signal is generated to trigger a "power on" or "audio play" signal, the audio transmission starts to transmit to the headphone speakers. And when the headphone is put off a user' head, the cushion 13 is released from the force sensor, which causes the squeezed piezo sheet 431,432 released, The electrical path between the two electrodes interrupts and a corresponding electrical signal is generated to trigger a "power off" or "audio pause" signal, the audio transmission stops so as to save power energy.

Figure 12A:
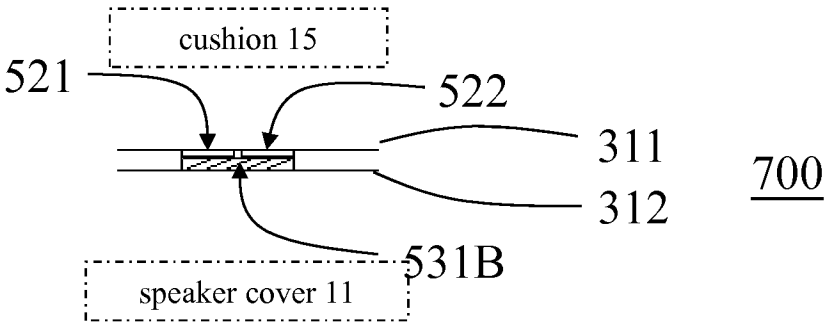
FIGS. 12A~12B show a seventh example for AA' section view of the force sensor according to the present invention.
Figure 12B:
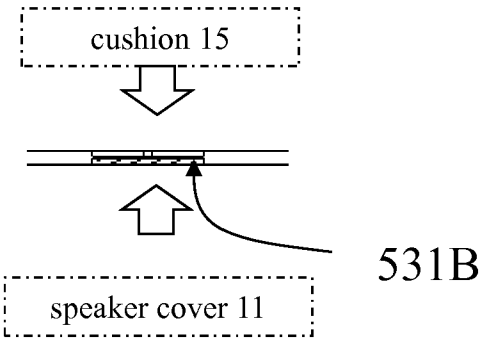

FIGS. 12A~12B show a seventh example for AA' section view of the force sensor according to the present invention.

FIG. 12A shows a seventh force sensor 700. The seventh force sensor shows a top left electrode 521 and a top right electrode 522 configured on a bottom surface of the top substrate 311. A piezo sheet 531B is configured on a top surface of the bottom substrate 312. The piezo sheet 531B has a top surface touching, but not giving force to, a bottom surface of the top electrodes 521, 522. The bottom surfaces of the top electrodes 521, 522 are coplanar.

FIG. 12B shows that when the headphone is put on a user' head, the cushion 15 is pushed against the force sensor 21, 212, 213, which causes the piezo sheet 531B of the force sensor squeezed. An electrical path is established between the two electrodes and a corresponding electrical signal is generated to trigger a "power on" or "audio play" signal, the audio transmission starts to transmit to the headphone speakers. And when the headphone is put off a user' head, the cushion 13 is released from the force sensor, which causes the squeezed piezo sheet 531B released, The electrical path between the two electrodes interrupts and a corresponding electrical signal is generated to trigger a "power off" or "audio pause" signal, the audio transmission stops so as to save power energy.

Figure 13A:
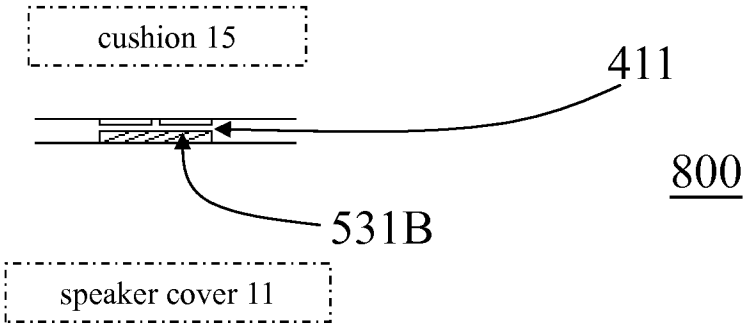
FIGS. 13A~13B show a eighth example for AA' section view of the force sensor according to the present invention.
Figure 13B:
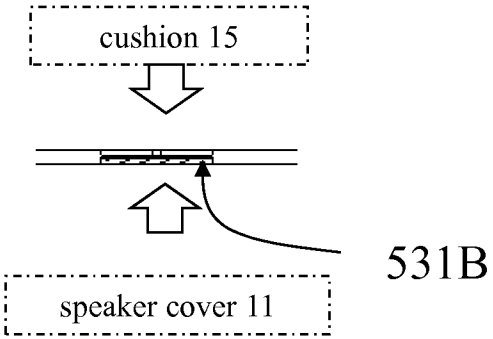

FIGS. 13A~13B show a eighth example for AA' section view of the force sensor according to the present invention.

FIG. 13A shows a eighth force sensor 800. The eighth force sensor is similar to FIG. 12A but a space 411 inserted between top electrodes 521, 522 and the piezo sheet 531B. The rest structures are the same as FIG. 12A and are omitted herein for simplification.

FIG. 13B is similar to that of FIG. 12B to show that when the headphone is put on a user' head, the cushion 15 is pushed against the force sensor 21, 212, 213, which causes the piezo sheet 531B of the force sensor squeezed. An electrical path is established between the two electrodes and a corresponding electrical signal is generated to trigger a "power on" or "audio play" signal, the audio transmission starts to transmit to the headphone speakers. And when the headphone is put off a user' head, the cushion 13 is released from the force sensor, which causes the squeezed piezo sheet 531B released, The electrical path between the two electrodes interrupts and a corresponding electrical signal is generated to trigger a "power off" or "audio pause" signal, the audio transmission stops so as to save power energy.

Figure 14A:
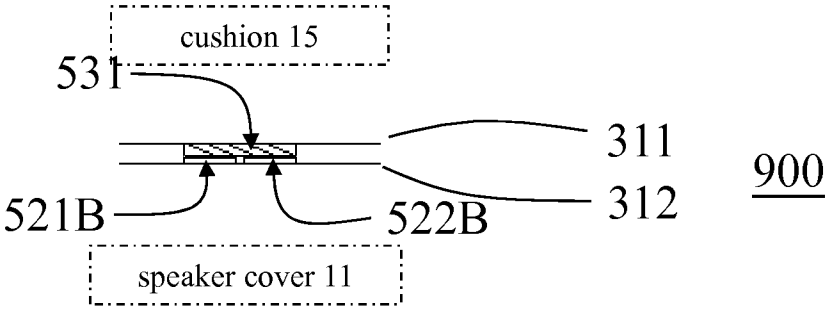
FIGS. 14A~14B show a ninth example for AA' section view of the force sensor according to the present invention.
Figure 14B:
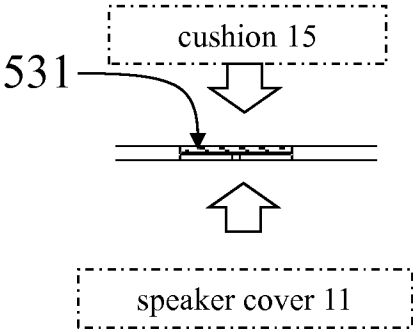

FIGS. 14A~14B show a ninth example for AA' section view of the force sensor according to the present invention.

FIG. 14A shows a ninth force sensor 900. The ninth force sensor shows that a piezo sheet 531 is configured on a bottom surface of a top substrate 311. A bottom left electrode 521B and a bottom right electrode 522B are configured on a top surface of a bottom substrate 312. The piezo sheet 531B has a bottom surface touching, but not giving force to, top surfaces of the electrodes 521B, 522B. The top surfaces of the electrodes 521B, 522B are coplanar.

FIG. 14B shows that when the headphone is put on a user' head, the cushion 15 is pushed against the force sensor 21, 212, 213, which causes the piezo sheet 531 of the force sensor squeezed. An electrical path is established between the two electrodes and a corresponding electrical signal is generated to trigger a "power on" or "audio play" signal, the audio transmission starts to transmit to the headphone speakers. And when the headphone is put off a user' head, the cushion 13 is released from the force sensor, which causes the squeezed piezo sheet 531 released, The electrical path between the two electrodes interrupts and a corresponding electrical signal is generated to trigger a "power off" or "audio pause" signal, the audio transmission stops so as to save power energy.

Figure 15A:
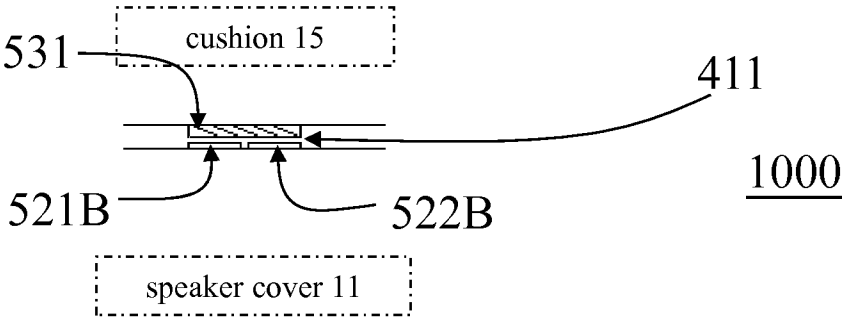
FIGS. 15A~15B show a tenth example for AA' section view of the force sensor according to the present invention.
Figure 15B:
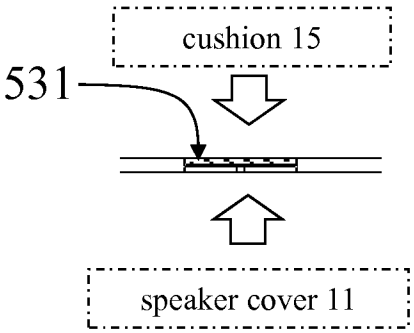

FIGS. 15A~15B show a tenth example for AA' section view of the force sensor according to the present invention.

FIG. 15A shows a tenth force sensor 1000. The tenth force sensor is similar to that of FIG. 14A but a space 411 is reserved between the piezo sheet 531 and the two electrodes 521B, 522B. The rest structures are similar to that of FIG. 14A and are omitted herein for simplification.

FIG. 15B is similar to that of FIG. 14B to show that when the headphone is put on a user' head, the cushion 15 is pushed against the force sensor 21, 212, 213, which causes the piezo sheet 531 of the force sensor squeezed. An electrical path is established between the two electrodes and a corresponding electrical signal is generated to trigger a "power on" or "audio play" signal, the audio transmission starts to transmit to the headphone speakers. And when the headphone is put off a user' head, the cushion 13 is released from the force sensor, which causes the squeezed piezo sheet 531 released, The electrical path between the two electrodes interrupts and a corresponding electrical signal is generated to trigger a "power off" or "audio pause" signal, the audio transmission stops so as to save power energy.

The force sensor used in this invention is one selected from a group consisting of: membrane switch, piezo-capacitive switch, piezo-electric switch, piezo-resistive switch, strain gauge, and micro electro mechanical systems (MEMS).

While several embodiments have been described by way of example, it will be apparent to those skilled in the art that various modifications may be configured without departs from the spirit of the present invention. Such modifications are all within the scope of the present invention, as defined by the appended claims.

What is claimed is:

1. A headphone, comprising:

a speaker configured to generate sound;

a speaker cover covering the speaker;

a cushion covering the speaker cover and configured to be in contact with an ear of a user, in use; and a force sensor sandwiched between the speaker cover and the cushion;

wherein in response to the cushion pressing against the force sensor in a direction toward the speaker cover and the speaker when the user puts on the headphone, the force sensor is configured to generate a first signal triggering power-on or playback of audio through the speaker, wherein the force sensor is a piezo switch comprising, between the cushion and the speaker cover:

a top left electrode having a first bottom surface;

a top right electrode having a second bottom surface, wherein the first bottom surface is coplanar with the second bottom surface; and a piezo sheet on bottom of the electrodes, wherein the electrodes are between the piezo sheet and the cushion, wherein the headphone further comprises a space between the piezo sheet and the electrodes when the cushion does not press against the force sensor, and wherein, in response to the cushion pressing against the force sensor in the direction toward the speaker cover and the speaker, the electrodes are moveable in said direction toward the piezo sheet to (i) contact the piezo sheet, and then (ii) squeeze the piezo sheet to establish an electrical path between the electrodes and through the piezo sheet for generating the first signal.

2. A headphone as claimed in claim 1, wherein in response to the cushion releasing a pressure against the force sensor when the user puts off the headphone, the force sensor is configured to generating a second signal triggering power-off or pausing said playback.

3. A headphone as claimed in claim 1, wherein the force sensor has a shape of a complete ring, said speaker cover includes a plurality of holes for sound emission in a center portion of the speaker cover, and said complete ring extends around said plurality of holes.

4. A headphone as claimed in claim 1, wherein the force sensor has a shape of a partial ring of at least one third of a complete ring, said speaker cover includes a plurality of holes for sound emission in a center portion of the speaker cover, and said complete ring extends around said plurality of holes.

5. A headphone as claimed in claim 1, wherein said speaker cover includes a plurality of holes for sound emission in a center portion of the speaker cover, a ring extends around said plurality of holes, and said force sensor comprises first and second force sensor pads separate from each other and arranged on the ring, at a left side and a right side, respectively.

6. A headphone as claimed in claim 5, wherein said force sensor further comprises third and fourth force sensor pads separate from each other and arranged on the ring, at a bottom side and a top side, respectively.

7. A headphone, comprising:

a speaker configured to generate sound;

a speaker cover covering the speaker;

a cushion covering the speaker cover and configured to be in contact with an ear of a user, in use; and a force sensor sandwiched between the speaker cover and the cushion;

wherein in response to the cushion pressing against the force sensor in a direction toward the speaker cover and the speaker when the user puts on the headphone, the force sensor is configured to generate a first signal triggering power-on or playback of audio through the speaker, wherein the force sensor is a piezo switch comprising, between the cushion and the speaker cover:

a bottom left electrode having a first top surface;

a bottom right electrode having a second top surface, wherein the first top surface is coplanar with the second top surface; and a piezo sheet on top of the electrodes, wherein the electrodes are between the piezo sheet and the speaker cover, wherein the headphone further comprises a space between the piezo sheet and the electrodes when the cushion does not press against the force sensor, and wherein, in response to the cushion pressing against the force sensor in the direction toward the speaker cover and the speaker, the piezo sheet is moveable in said direction toward the electrodes to (i) contact the electrodes, and then (ii) be squeezed to establish an electrical path between the electrodes and through the piezo sheet for generating the first signal.

8. A headphone, comprising:

a speaker configured to generate sound;

a speaker cover covering the speaker;

a cushion covering the speaker cover and configured to be in contact with an ear of a user, in use; and a force sensor sandwiched between the speaker cover and the cushion;

wherein in response to the cushion pressing against the force sensor in a direction toward the speaker cover and the speaker when the user puts on the headphone, the force sensor is configured to generate a first signal triggering power-on or playback of audio through the speaker, wherein the force sensor is a piezo switch comprising, between the cushion and the speaker cover:

a top left electrode having a first bottom surface;

a top right electrode having a second bottom surface, wherein the first bottom surface is coplanar with the second bottom surface; and a piezo sheet on bottom of the electrodes, wherein the electrodes are between the piezo sheet and the cushion, wherein, when the cushion does not press against the force sensor, the electrodes contact, without applying a force to, the piezo sheet, and wherein, in response to the cushion pressing against the force sensor in the direction toward the speaker cover and the speaker, the electrodes are moveable in said direction to squeeze the piezo sheet and establish an electrical path between the electrodes and through the piezo sheet for generating the first signal.

9. A headphone, comprising:

a speaker configured to generate sound;

a speaker cover covering the speaker;

a cushion covering the speaker cover and configured to be in contact with an ear of a user, in use; and a force sensor sandwiched between the speaker cover and the cushion;

wherein in response to the cushion pressing against the force sensor in a direction toward the speaker cover and the speaker when the user puts on the headphone, the force sensor is configured to generate a first signal triggering power-on or playback of audio through the speaker, wherein the force sensor is a piezo switch comprising, between the cushion and the speaker cover:

a bottom left electrode having a first top surface;

a bottom right electrode having a second top surface, wherein the first top surface is coplanar with the second top surface; and a piezo sheet on top of the electrodes, wherein the electrodes are between the piezo sheet and the speaker cover, wherein, when the cushion does not press against the force sensor, the electrodes contact, without applying a force to, the piezo sheet, and wherein, in response to the cushion pressing against the force sensor in the direction toward the speaker cover and the speaker, the piezo sheet is moveable in said direction toward the electrodes to be squeezed and establish an electrical path between the electrodes and through the piezo sheet for generating the first signal.

* * * * *